United States Patent [19]

Urbanek

[11] 4,198,027

[45] Apr. 15, 1980

[54] RESILIENT SUPPORT FOR LAMP

[75] Inventor: Karel Urbanek, Weston, Canada

[73] Assignee: Dominion Auto Accessories Limited, Toronto, Canada

[21] Appl. No.: 903,759

[22] Filed: May 8, 1978

Related U.S. Application Data

[62] Division of Ser. No. 823,747, Aug. 11, 1977, Pat. No. 4,103,323, which is a division of Ser. No. 724,522, Sep. 20, 1976, Pat. No. 4,118,767.

[51] Int. Cl.[2] ..... A45D 19/04

[52] U.S. Cl. ..... 248/634; 362/306; 362/369; 362/390

[58] Field of Search ..... 362/390, 306, 369; 248/634

[56] References Cited

U.S. PATENT DOCUMENTS 4,103,323 7/1978 Urbanek ..... 362/390

*Primary Examiner*—Stephen J. Lechert, Jr.

*Attorney, Agent, or Firm*—Barnes, Kisselle, Raisch & Choate

[57] ABSTRACT

A lamp comprising socket mounting assembly which includes a retainer engaging the interior of said hollow portion of said housing. The retainer has an opening therein and a shock absorbing mount member extends through the opening. The member is made of resilient material and has spaced annular flanges extending along opposite sides of the retainer. One of the flanges has circumferentially spaced integral protuberances extending axially and engaging one surface of the retainer for holding the opposite surface of the retainer against the opposite flange. The shock mounting member has an axially extending opening therein. A socket retainer has a planar surface engaging the end of the shock mounting member. The socket retainer has portions thereof crimped into engagement with the periphery of the shock mounting member. A socket member has an end with a reduced diameter extending through the opening in the socket retainer and the end is crimped outwardly.

2 Claims, 20 Drawing Figures

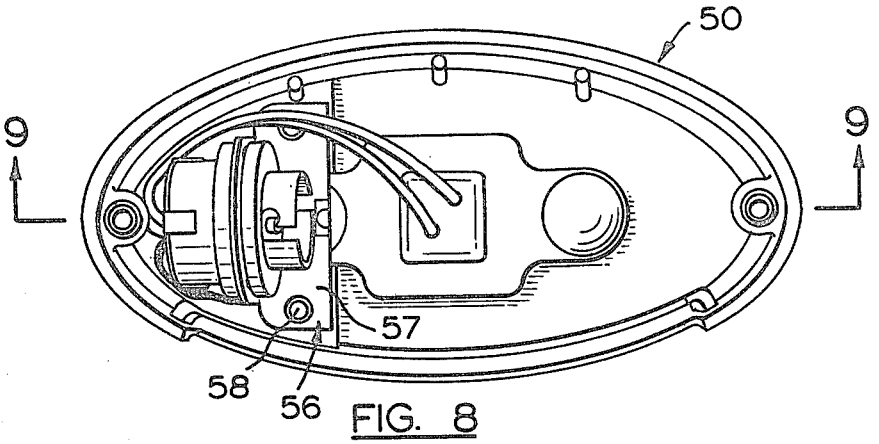
FIG. 8
FIG. 9
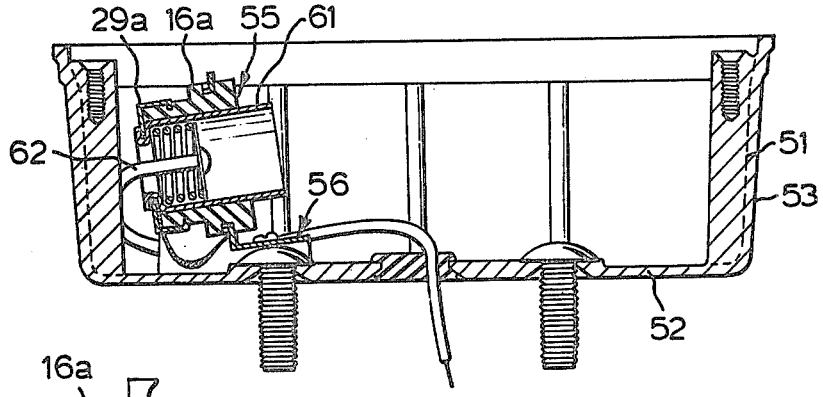
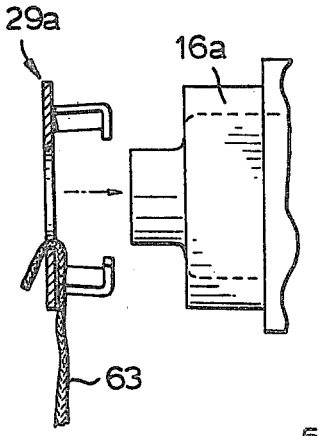
FIG. 10
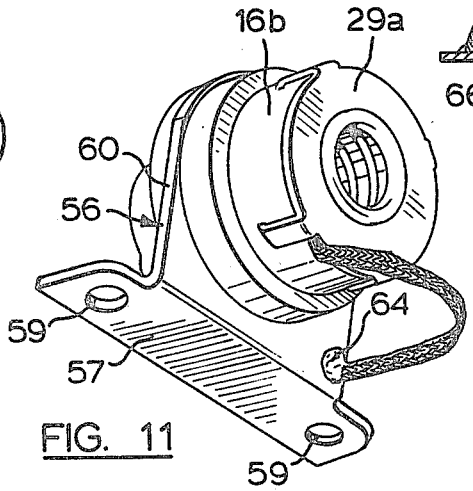
FIG. 11
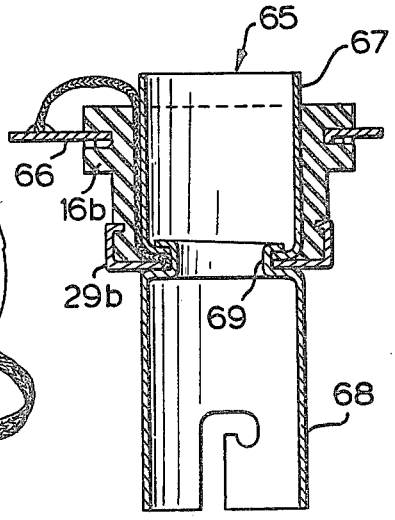
FIG. 12

RESILIENT SUPPORT FOR LAMP

This is a division of application Ser. No. 823,747, filed Aug. 11, 1977 now U.S. Pat. No. 4,103,323 which is, in turn, a division of application Ser. No. 724,522, filed Sept. 20, 1976 now U.S. Pat. No. 4,118,767.

This invention relates to lamps and particularly lamps that are adapted to be mounted on an automotive vehicle.

BACKGROUND OF THE INVENTION

In automotive vehicles such as trucks, it is common to utilize a lamp to delineate the outline or configuration of portions thereof such as the cab. In one well known type of such lamp shown in U.S. Pat. No. 3,096,026, a housing is angularly adjustably mounted upon a base and supports a lamp in a shock mount.

One of the main disadvantages recognized in constructions such as that set forth in U.S. Pat. No. 3,096,026 arises from the complexity of assembly. The use of such a construction virtually precludes the application of any automated assembly procedures. As a consequence, the cost becomes prohibitive for applications where high volume requirements are present.

Among the objects of the invention are to provide an improved lamp which has a simple, effective shock absorbing mounting; which is easily assembled; and which will withstand severe usage without damage.

SUMMARY OF THE INVENTION

In accordance with the invention, the lamp comprises a socket mounting assembly which includes a shock mounting member extending through the opening of a retainer and having spaced annular flanges extending along opposite sides of said retainer. The shock mounting member has an axially extending opening therein. A socket retainer having a planar surface engages the end of the shock mounting member. The socket retainer has portions thereof crimped into engagement with the periphery of said shock mounting member. A socket member has an end with a reduced diameter extending through the opening in the socket retainer. The reduced end is crimped outwardly into engagement with the opposite surface of the flange on the spacer.

DESCRIPTION OF THE DRAWINGS

FIG. 8 is a plan view of a modified form of the invention.

FIG. 9 is a sectional view taken along the line 9—9 in FIG. 8.

FIG. 10 is a part sectional exploded view of a part of the lamp shown in FIGS. 8 and 9.

FIG. 11 is a perspective view of the socket mounting assembly of the lamp shown in FIGS. 8 and 9.

FIG. 12 is a sectional view of a modified form of socket mounting assembly.

DESCRIPTION

Figure 1:
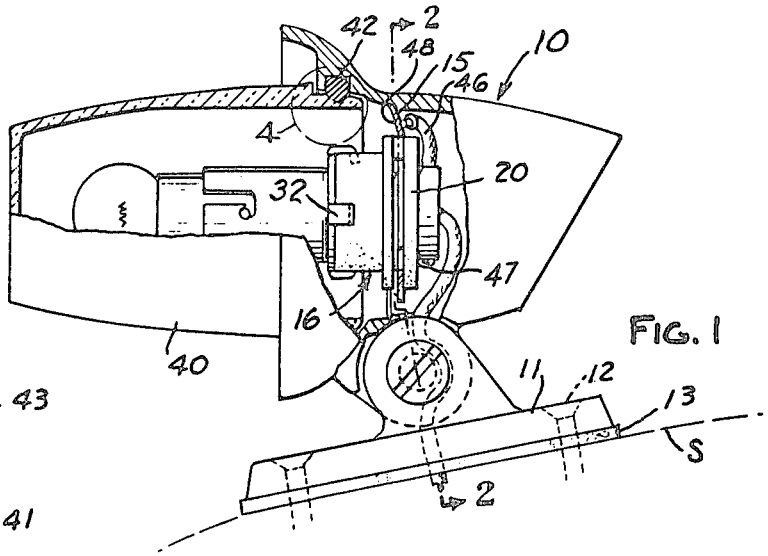
FIG. 1 is a part sectional elevational view of a marker lamp embodying the invention.

Referring to FIG. 1, the marker lamp comprises a hollow housing 10 which is angularly adjustably mounted on a base 11 that is, in turn, fixed to the surface of the automotive vehicle S by screws 12 extending through the base and a resilient pad 13.

The interior of the housing is hollow. A socket mounting assembly is provided therein and includes a flat spring retainer 14 having three equally spaced radially projecting portions 15 engaging the interior surface. The spring retainer 14 has an opening 17 having a notch 17*a*. A shock mounting member 16 of resilient material, such as rubber, is mounted through the opening 17 in the spring retainer 14 and comprises a cylindrical body 18 having spaced flanges 19,20 at one end defining a groove 21 which receives the spring retainer 14. Flange 19 includes four axially extending cylindrical protuberances 22 having flat ends that engage one surface of the spring retainer to urge it against the side of groove 21. Although integral protuberances 22 are preferred, the axial positioning of spring retainer 14 with respect to shock mounting member 16 can also be achieved by forming an annular axially extending U-shaped rib on spring retainer 14 which engages one side of groove 21 to hold spring retainer 14 against the other side of groove 21.

The base 23 of the groove 21 has four outwardly extending radial projections 24 which are spaced equally apart circumferentially and are arcuate and engage the opening 17 of spring retainer 14 to frictionally hold the shock mounting member 16 against circumferential movement as well as to suspend spring retainer 14.

Figure 5:
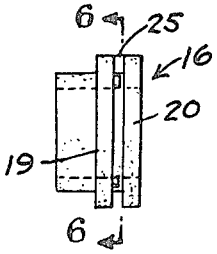
FIG. 5 is a side elevational view of the shock mounting member utilized in the lamp.
Figure 6:
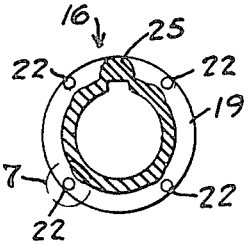
FIG. 6 is a sectional view taken along the line 6—6 in FIG. 5.
Figure 2:
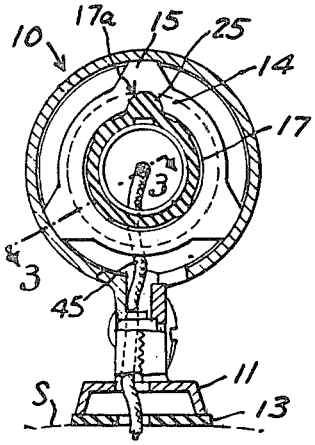
FIG. 2 is a sectional view taken along the line 2—2 in FIG. 1.
Figure 7:
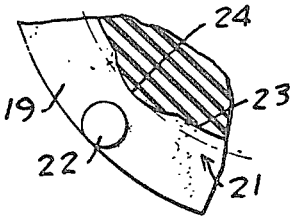
FIG. 7 is an enlarged sectional view of the circle 7 in FIG. 6.

The shock mounting member also includes a portion 25 that is integral and extends between the flanges 19,20 to provide rigidity thereto. Portion 25 extends into notch 17*a* in opening 17 of spring retainer 14 to hold shock mounting member 16 against circumferential movement. (FIG. 5).

A spacer 26 which is generally cylindrical and made of metal is press fitted into opening 27 in the shock mounting member 16 and has a radially inwardly turned flange 28. A socket retainer 29 made of metal includes an annular portion 30 that engages the outer surface 31 of flange 28. Retainer 29 is held in position by crimping spaced fingers or portions 32 along the outer surface of the body 18 and inwardly into the body.

Figure 3:
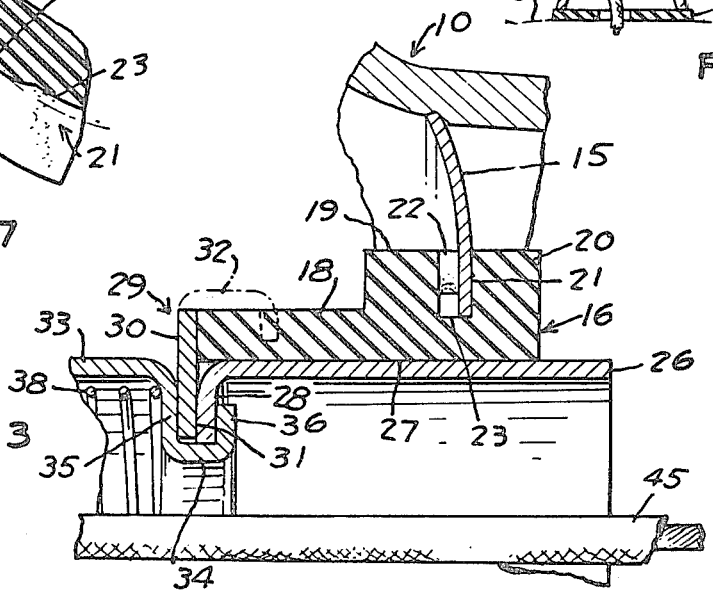
FIG. 3 is a fragmentary sectional view on an enlarged scale taken along the line 3—3 in FIG. 2.

A socket 33 which is generally cylindrical has a portion 34 of reduced diameter extending through the opening in the portion 30 of retainer 29 with an interconnecting portion 35 engaging the outer surface of retainer 29. The free end 36 of the socket is crimped outwardly against the other surface of flange 28 of spacer 26 (FIG. 3).

In this manner, the socket 33 is resiliently mounted in the housing 10 firmly and such that it will provide long life for the bulb 44. The socket has a spring 38 and associated pigtail wiring assembly 45 in accordance with conventional construction.

Figure 4:
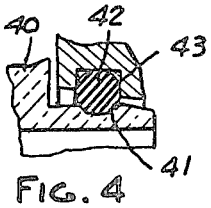
FIG. 4 is a view of the portion in the circle 4 in FIG. 1 on an enlarged scale.

A lens 40 having a semi-circular groove 41 at one end extends inwardly of the housing so that an O-ring 42 in a rectangular opening 43 in the housing 10 engages the groove 41 to hold the lens 40 in position. Groove 41 has an axial width greater than the diameter of O-ring 42 (FIGS. 4, 8).

The construction of the lamp is thus such that it is adaptable to automated assembly procedures.

In this form of the invention, the ground connection is made by a wire 46 that is soldered at one end to the spacer 26 as at 47 and at the other end to the spring retainer 14 as at 48.

In the modified form of the invention shown in FIGS. 8–11, the lamp 50 comprises a housing 51 having a base wall 52 and a peripheral wall 53. A lens, not shown, is mounted on the peripheral wall 53 to close the open end of the hollow housing 51. In this form, the socket mounting assembly 55 comprises a retainer bracket 56 that includes a base portion 57 mounted on the base wall 52 by deformed portions 58 extending upwardly from the base wall 52 through openings 59 in the base 57 and an upstanding portion 60 having an opening through which the shock mounting member **16*a* is passed. The shock mounting member 16*a* is of identical construction to that described in connection with the form of the invention shown in FIGS. 1–7. The socket mounting assembly further includes a socket retainer 29*a* that engages the end of the shock mounting member 16*a* and has portions clamped into the sides of the body thereof, as in the previous form of the invention. In the present form, the socket 61 extends through the opening of the shock mounting member 16*a* and the end thereof is crimped over the retainer 29*a*. A pigtail assembly 62 extends to the interior of the socket. A ground connection is provided in this form by a braided metal lead 63 that is clamped between the socket retainer 29*a* and the end of the shock mounting member 16*a* at the one end and is soldered to the upstanding wall 60 of the bracket 56 at the other end, as shown at 64**.

In the modified form of socket mounting assembly 65 shown in FIG. 12, the bracket 66 supports the shock mounting member **16*b*. In this form, a spacer 67 extends through the shock mounting member 16*b* and the socket 68 extends axially beyond the shock mounting member 16*b*. As in the form of the invention shown in FIGS. 1–7, the crimping over of the end 69 of the socket joins the spacer 67 and socket retainer 29*b***.

Figure 13:
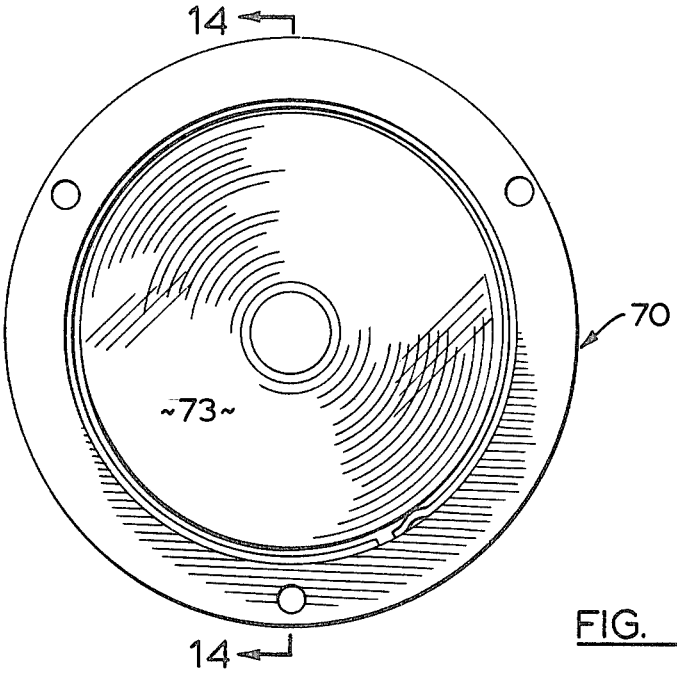
FIG. 13 is an elevational view of another lamp embodying the invention.
Figure 14:
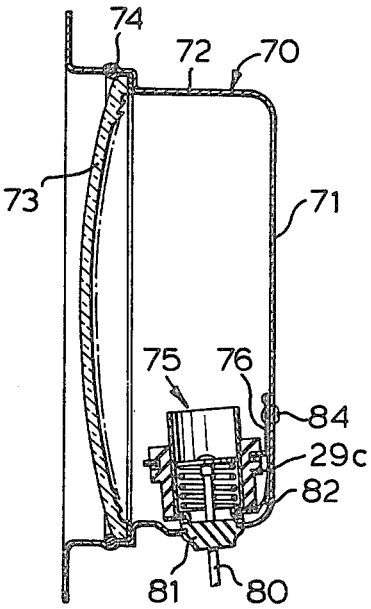
FIG. 14 is a sectional view taken along the line 14—14 in FIG. 13.
Figure 15:
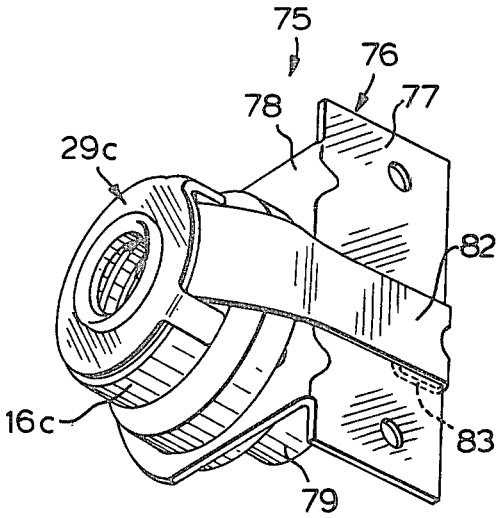
FIG. 15 is a perspective view of the socket mounting assembly shown in FIG. 14.
Figure 16:
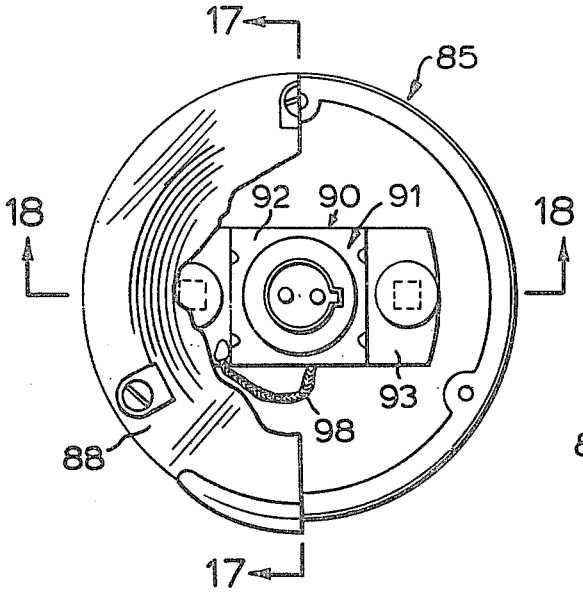
FIG. 16 is an elevational view of another lamp embodying the invention, parts being broken away.
Figure 17:
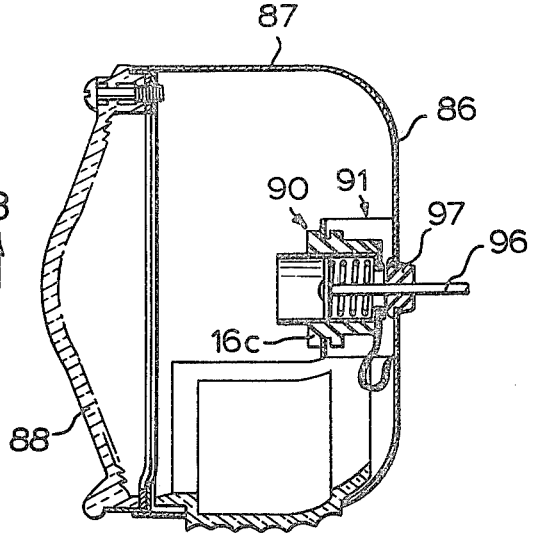
FIG. 17 is a sectional view taken along the line 17—17 in FIG. 16.
Figure 18:
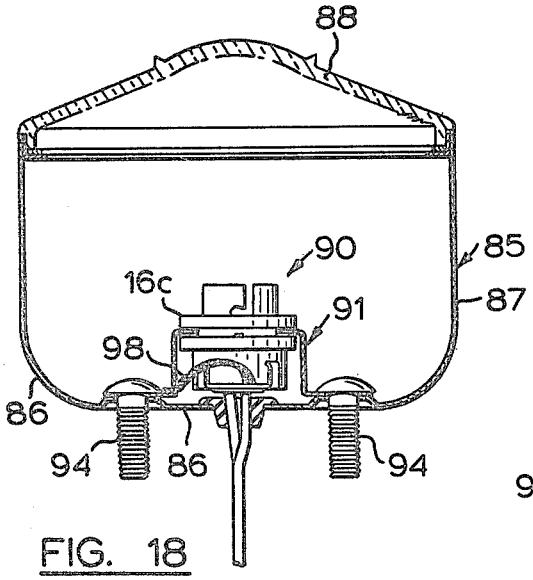
FIG. 18 is a sectional view taken along the line 18—18 in FIG. 16.

In the lamp shown in FIGS. 13–15, the lamp comprises a housing 70 having a base wall 71 and peripheral wall 72 defining an open end that is closed by a lens 73 held in position by a snap ring 74. The socket mounting assembly 75 comprises a bracket 76 having a base 77 and upstanding wall 78 through which the shock mounting member **16*c* of similar construction to that used in the previous form of the invention is mounted. As in the form of the invention shown in FIGS. 8–11, the socket 79 extends through the shock mounting member 16*c* and the end thereof is crimped over socket retainer 29*c*. The conventional pigtail assembly 80 extends through a grommet 81 to the interior of the socket and the ground connection is made by a flexible metal strap 82 that is crimped between the socket retainer 29*c* and the end of the socket mounting member 16*c* at one end and is folded over the base 77 of the bracket 76 as at 83 at the other end so that when the bracket 76 is mounted on the base wall 71 by rivets 84**, the ground connection is completed.

In the form of the invention shown in FIGS. 16–19, the lamp 85 comprises a housing having a base wall 86 and a peripheral wall 87 that has an open end closed by a lens 88. The socket mounting assembly 90 comprises a bracket 91 that includes a U-shaped portion 92 and spaced flanges 93, the latter having openings through which screws 94 extend to hold the bracket on the base wall 86 and also mount the lamp on a vehicle or the like. The shock mounting member **16*d* of similar construction to those previously described is supported on the base of the U-shaped portion 92 and the socket 95 extends through the shock mounting member 16*d*. As in the previous forms, a socket retainer 29*d* is connected to the socket 95** by crimping over the end of the socket and retains the socket in position by bending over of the tabs thereon.

In the form of the invention shown in FIGS. 16–19, a conventional pigtail assembly 96 extends through a grommet 97 in the base wall 86 and a ground connection is achieved by a braided metal lead 98 which is clamped between the socket retainer **29*d* of the shock mounting member 16*d* at the one end and is soldered to the bracket 91 at the other end as at 99**.

Figure 20:
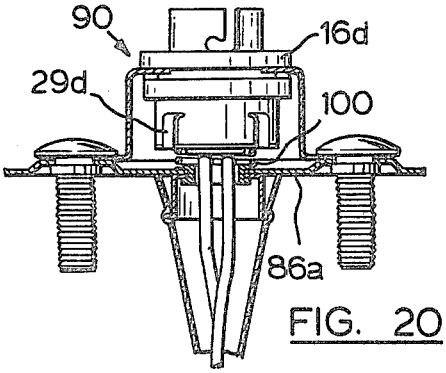
FIG. 20 is a fragmentary sectional view of a modified form of the invention.
Figure 19:
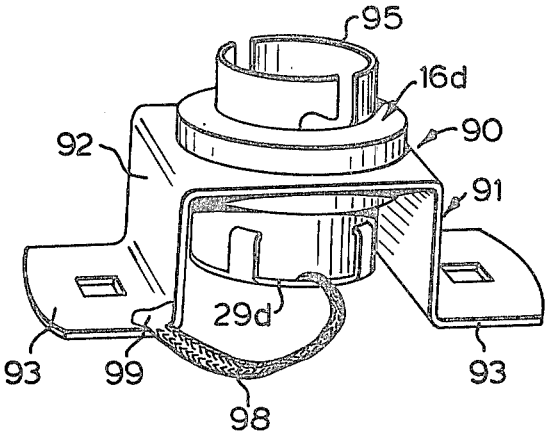
FIG. 19 is a perspective view of the socket mounting assembly shown in FIGS. 17 and 18.

The form of the invention shown in FIG. 20 is identical to that shown in FIGS. 16–19 except that the ground connection is achieved by a spring 100 interposed between the base wall **86*a* and the socket retainer 29*d***.

In each of the forms of the invention, the shock mounting members 16, **16*a*, 16*b*, 16*c*, 16*d*** are identical in construction.

I claim:

1. For use in a lamp, a shock mounting member comprising:

a body of resilient material, said body having spaced radially extending annular flanges defining a groove, said body having an opening extending axially therethrough, one of said flanges having circumferentially spaced integral protuberances extending axially through said groove toward the other flange.

2. The combination set forth in claim 1 wherein said axially extending protuberances comprise cylindrical members having flat ends.

* * * * *